United States Patent [19]

Gauthier et al.

[11] 4,184,583

[45] Jan. 22, 1980

[54] DEVICE FOR USE IN THE EMPTYING OF DREDGING BUCKETS

[75] Inventors: Michel Gauthier, Saint-Renan; François Le Foll; Christian Charles, both of Brest, all of France

[73] Assignee: Centre National pour l'Exploitation des Oceans, Paris, France

[21] Appl. No.: 860,895

[22] Filed: Dec. 15, 1977

[30] Foreign Application Priority Data

Dec. 17, 1976 [FR] France ..... 76 38038

[51] Int. Cl.[2] ..... E02F 3/14

[52] U.S. Cl. ..... 198/703; 37/69

[58] Field of Search ..... 198/343, 792, 796, 703, 198/509, 483; 37/69, DIG. 8

[56] References Cited

U.S. PATENT DOCUMENTS

| | | | |
|---|---|---|---|
| 2,725,970 | 12/1955 | Wullschleger | 198/343 X |
| 3,672,079 | 6/1972 | Masuda et al. | 37/69 |
| 3,889,403 | 6/1975 | Gauthier et al. | 37/69 |
| 3,947,980 | 4/1976 | Andrews et al. | 37/69 |

FOREIGN PATENT DOCUMENTS

| | | | |
|---|---|---|---|
| 1239178 | 7/1971 | United Kingdom | 37/69 |

*Primary Examiner*—Clifford D. Crowder
*Attorney, Agent, or Firm*—Fleit & Jacobson

[57] ABSTRACT

A guide is provided for the buckets of an endless dredging line comprising an emptying station incorporated into the guide. A system comprising a pair of trolleys and a pulley system is provided to hold each bucket stationary at the emptying station for dumping. The endless line travels over the pulleys, some of which are mounted on the trolleys. When a bucket approaches the emptying station, the trolleys are actuated to travel in opposite directions so as to allow the endless line to move at its normal speed while holding the bucket at the dumping station stationary.

10 Claims, 2 Drawing Figures

Figure 1:
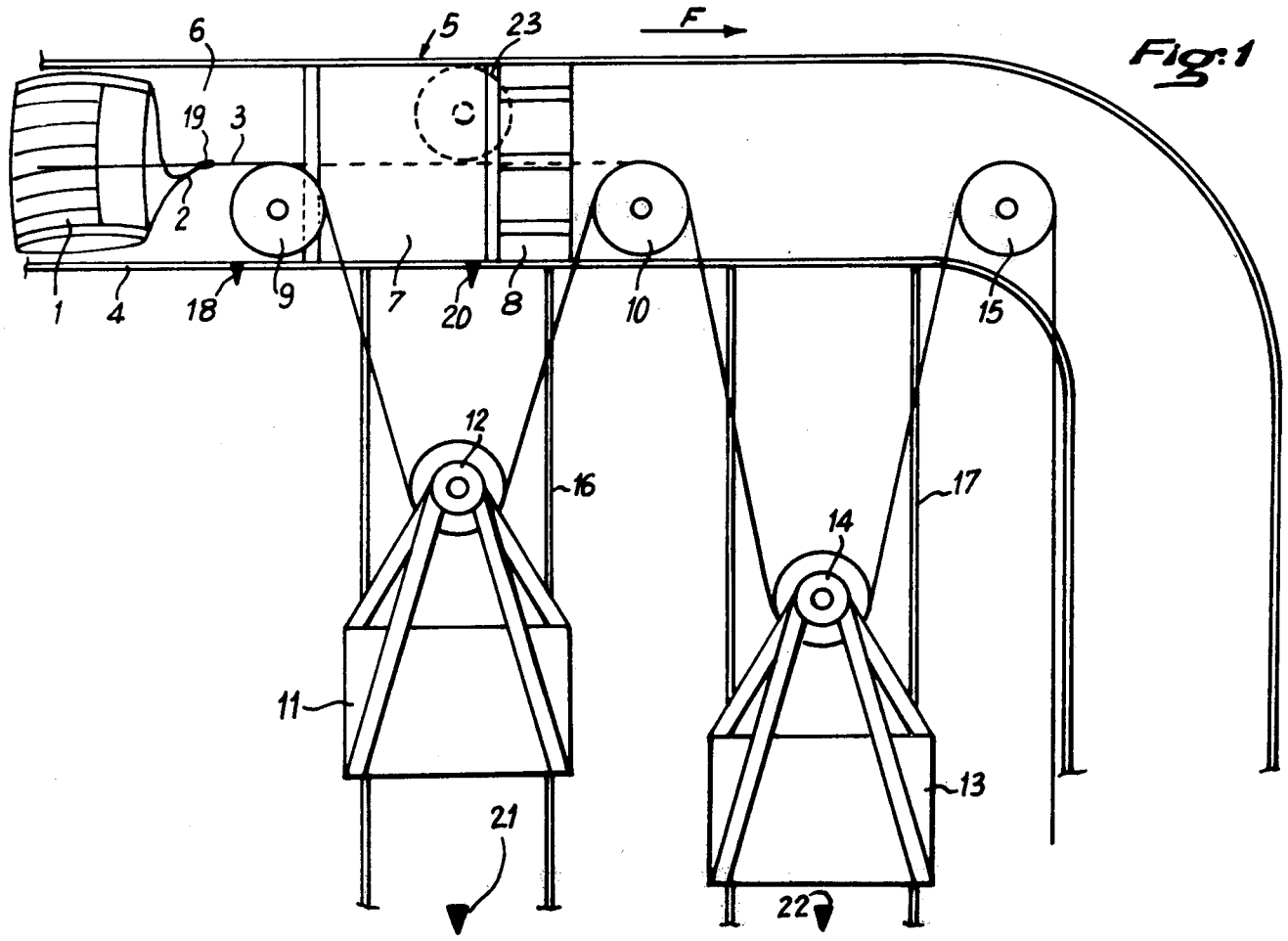

F
1
2
3
4
5
6
7
8
9
10
11
12
13
14
15
16
17
18
19
20
21
22
23

DEVICE FOR USE IN THE EMPTYING OF DREDGING BUCKETS

This invention relates to a device for emptying dredging buckets which are fixed to an endless dredging line for continuous seabed dredging; such a line is described in French Pat. No. 2,185,747. U.S. Pat. No. 3,889,403 is an English language equivalent of this French patent.

In use, such an endless dredging line, fitted with buckets, is lowered to the seabed from one ship, raised on board a second ship called the "lifting ship" where the buckets are emptied, and returned to the first ship via a partly immersed section. The two ships move in the same direction as each other along generally parallel routes during this operation. Dredging buckets particularly suitable for this technique and connected by cable to the endless dredging line, are described in French Pat. Application No. 76-28,291.

So far as possible, the emptying of the buckets on the lifting ship should take place without interfering with the movement of the endless dredging line. Otherwise, such interruptions could lead to irregular collection of the sediments, and stressing of the dredging line to a damaging degree. One object of the present invention is to provide a device for emptying the buckets without requiring their disconnection from the endless dredging line, and without interfering with the operation of the line.

Another object of the present invention is to provide a device of this type capable of emptying buckets weighing several tonnes when loaded with collected sediment.

A further object is to provide a device which is simple and robust as possible, bearing in mind that the dredging operations have to take place over long periods, and any accidental interruption to the movement of the endless dredging line would have a very adverse effect on the satisfactory operation of the dredging equipment.

According to this present invention there is provided a device for use in the emptying of dredging buckets which are fixed by cables to an endless dredging line, the device comprising guide means for said buckets, an emptying station for the buckets and incorporated in said guide means, at least two bodies arranged to move in synchronism along paths generally perpendicular to the direction of movement of the buckets passing through the emptying station, and means for actuating said bodies when a bucket approaches said station, said endless line running over said bodies and alternately over at least three members at said guide means so that, on actuation of said bodies by an approaching bucket, the bodies move from initial positions through a first half cycle to bring the point of attachment of the cable of that bucket to the endless line to rest or nearly to rest during emptying of the bucket at the station, and then through a second half cycle to return to said initial positions, without affecting the movement of the lengths of dredging line outside the device.

Preferably, said bodies run on guides.

Suitably, the bucket guide means comprise a more or less horizontal channel.

The emptying station may comprise a tilting plate which forms part of the floor of said channel and is arranged to pivot about an axis at floor level and perpendicular to the direction of movement of the buckets, and a hopper which opens at the level of the floor of the channel and which is mounted to receive the contents of successive buckets on tilting of said plate.

Preferably also, facilities are provided for automatic control of the emptying of the buckets and the movements of said bodies.

Figure 2:
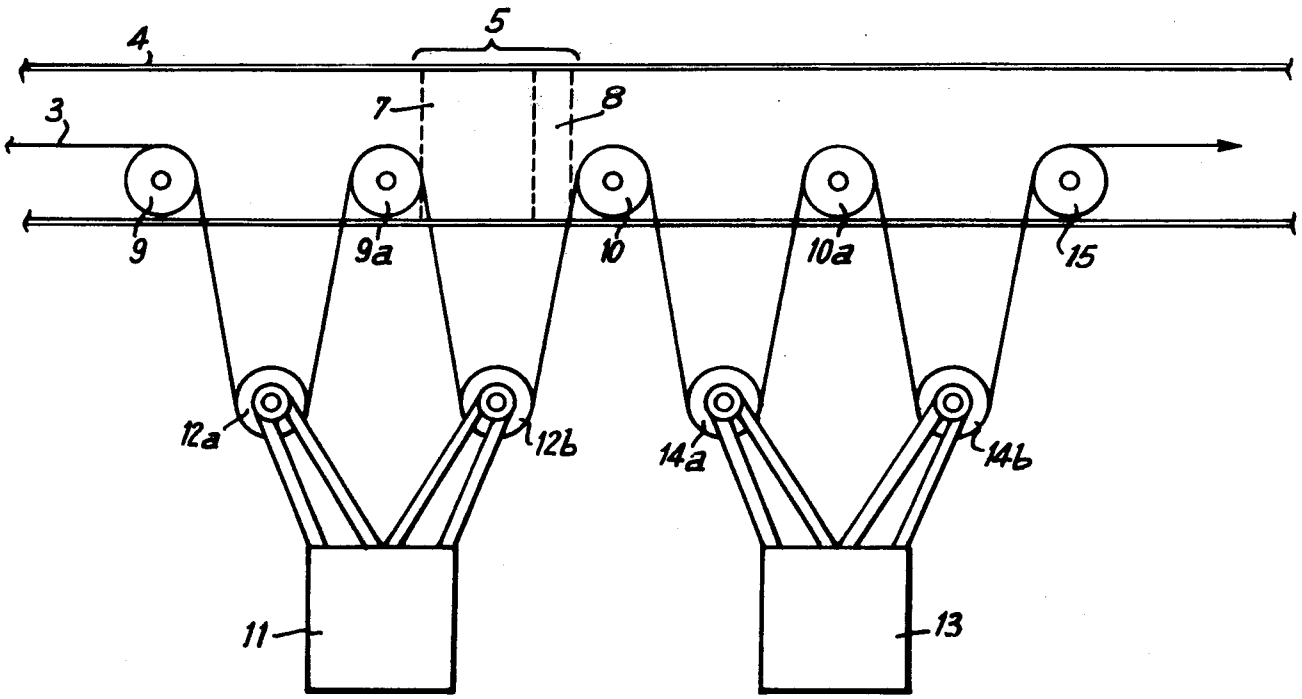

Embodiments of the present invention will now be described, by way of example, with reference to the accompanying diagrammatic drawings in which:

FIG. 1 is a plan view showing one form of bucket emptying device according to the invention; and, FIG. 2 is a similar plan view showing an alternative form of device according to the invention.

As will be seen from FIG. 1 of the drawings, dredging bucket 1 is attached by a cable 2 to an endless dredging line 3, and a succession of such buckets are suitably spaced along the line. The bucket 1 moves in a generally horizontal channel 4 along which it is drawn by the movement of the endless line 3.

The channel incorporates an emptying station 5. Floor 6 of the channel 4, over which the bucket slides, has a tilting plate 7 and a hopper 8 which opens at the same level as the channel and lies just beyond the emptying station 5 in the direction of movement of the buckets which is indicated by arrow F in FIG. 1. The tilting plate 7 pivots about an axis 23 at floor level and perpendicular to the direction of movement of the buckets. The hopper 8 incorporates longitudinal bars to prevent the buckets from falling when the plate 7 tilts forward. The hopper 8 is also mounted above a means (not shown) for storage or conveying of the sediment dumped into it on tilting of the plate 7 with the bucket 1.

Two vertical-axis pulleys 9,10 flank the emptying station 5 in the longitudinal direction: the first, 9, will be called the "inlet pulley", while the other, 10, will be called the "intermediate pulley". Between the pulleys 9 and 10 is a trolley 11 carrying a pulley 12 over which runs the endless dredging line 3 after it has passed over the inlet pulley 9 and before reaching the intermediate pulley 10. The trolley is free to move in a direction approximately perpendicular to the direction of movement of the bucket 1.

Beyond pulley 10, in the direction of movement of the bucket, there is arranged in a similar way to the trolley 11, a second trolley 13 which also carries a pulley 14 over which the endless dredging line 3 runs. Then, further in the direction of movement of the bucket, is a pulley 15 called the "outlet pulley" arranged in a similar way to pulleys 9 and 10. The pulley 10 is positioned approximately mid-way between the inlet and outlet pulleys.

The endless dredging line 3 thus runs in succession over pulleys 9, 12, 10, 14 and 15, after its passage over drive and tension-control pulleys (not shown).

When the trolley 11 is at that end of its path of travel nearest the channel 4, the position of the endless dredging line 3, as shown in dotted lines in FIG. 1, coincides with a tangent common to pulleys 9, 12 and 10. When the moving truck 13 is at that end of its path of travel, the pulleys 10, 14 and 15 are similarly positioned.

The trolleys 11 and 13 move respectively on guides 16 and 17, which lie approximately perpendicular to channel 4. The two trolleys 11 and 13 are arranged to reciprocate in synchronism, so that their movements are opposite in direction to one another. This means that, for example, when the trolley 11 approaches the channel 4, the trolley 13 withdraws from the channel at a similar rate, and therefore the length of the endless line 3 between the inlet and outlet pulleys 9 and 15 remains more or less constant during operation of the dredging assembly.

The duration of one half cycle, i.e. the time taken by a trolley to complete a forward or return movement, is at least equal to the emptying time of a bucket.

The operation of the device according to this present invention can be described as follows.

When a bucket 1 has been slung on board the lifting ship, it is carried in a suitable guide device which locates the bucket 1 so that its base slides along the floor 6 of channel 4. The trolleys are initially at rest, with trolley 11 at the channel 4, and trolley 13 at its furthest point from the channel. The endless dredging line 3 is driven by a device (not shown) which is preferably located between the point of arrival of the buckets on board the lifting ship, and the device which is the object of this present invention, since this arrangement minimises the tension in the endless dredging line 3.

As bucket 1 approaches the emptying station 5, it trips the first contactor 18 which starts the movement of the trolleys; trolley 11 withdraws from the channel 4, and trolley 13 moves towards the channel. At this time, the point of attachment 19 of the cable 2 to the endless dredging line 3, still has not reached pulley 10, and the accelerated motion of the trolleys reduces the speed of the point of attachment 19 to more or less zero as it reaches the pulley 10. While the movement of the point of attachment 19 is so reduced, the bucket 1 reaches the tilting plate 7 and trips a second contactor 20 to cause the plate 7 to be pivoted upwardly about its axis 23, and the sediment is emptied from the bucket 1 into the hopper 8. The bucket should be at least momentarily halted in its movement forward along channel 4, as the length of dredging line 3 between pulleys 12 and 14 is brought virtually to rest because of the opposed movements of the trolleys 11 and 13. The various other lengths of the line 3 move continuously, and the trolley speeds, which are more or less the same, are controlled by the rate of movement of the line.

When the trolley 11 reaches the end of its travel, corresponding to the end of the period during which the bucket 1 is emptied, this trolley trips a contactor 21 to actuate the reverse movements of the trolleys 11 and 13. Then the movement of the point of attachment 19 restarts, to draw the bucket 1 along the channel 4 beyond the emptying station 5. When the trolley 13 returns to its initial position, remote from the channel 4, it trips a contactor 22 which halts the movement of the trolleys which have now completed their cycle.

A fresh operating cycle is started by the action of the next bucket tripping the contactor 18.

Each of the contactors 18, 20, 21 and 22 can comprise any suitable device which, linked to relays, can trip mechanical movements. The use of such contactors permits tripping of the emptying operation by the bucket itself. As the speeds of the trolleys 11 and 13 are governed by the rate of movement of the endless dredging line 3, the spacing of successive buckets along the line must be sufficient to enable an operating cycle of the trolleys to take place. The emptying of the buckets can therefore be completely automated.

Referring now to FIG. 2, the trolleys 11 and 13 each carry two pulleys, **12*a* and 12*b* for the first and 14*a* and 14*b* for the second. Pulleys 9, 9*a*, 10, 10*a* and 15 are regularly spaced along the channel 4, and the endless dredging line 3 runs in succession over pulleys 9, 12*a*, 12*b*, 10, 14*a*, 10*a*, 14*b* and 15. The emptying station 5 is located between pulleys 9*a* and 10. One advantage of this embodiment is that it reduces the travel of the trolleys 11 and 13, in comparison with the layout illustrated in FIG. 1**, while maintaining the same emptying time.

Further modifications may be made without departing from the scope of the present invention. For example, moving trolley 13 may be located in a suitable alternative position along channel 4. Also, the trolleys 11 and 13 are shown located at the same side of the channel 4, but they could be arranged on opposite sides.

The portions of the endless dredging line interlinking the pulleys of the device may lie parallel to each other. In such a case, however, the pulleys on the trolleys 11 and 13 must not move between the pulleys at the channel 4, which should not be a drawback if cable 1 is of sufficient length.

What we claim is:

1. A device for emptying dredging buckets attached by cables to points spaced along a continuously moving endless dredging line, said device comprising:

substantially horizontally-extending first guide means for guiding movement of the buckets; and means defining an emptying station associated with said guide means and including:

first and second bodies arranged to move in synchronism in opposite directions along generally-vertically extending paths between first and second positions, in the first positions the endless dredging line passing over said bodies in a substantially straight line parallel to said guide means, in the second positions the endless dredging line passing over said bodies and being moved by said bodies away from said guide means;

second guide means positioned between said first and said second bodies and cooperating with said bodies in said first positions to define a substantially straight path for guiding the endless dredging line;

means for controlling movement of said bodies so that said first body is in said first position and said second body is in said second position prior to arrival of a bucket at said emptying station, said first body being moved towards said second position, after the point of attachment of a bucket to the dredging line passes the first body, at a rate of speed sufficiently fast to substantially stop movement of the point of attachment at said second guide means; and actuatable means associated with said first guide means for dumping a bucket when movement of its point of attachment is substantially stopped.

2. A device according to claim 1, in which said bodies comprise two trolleys, each carrying at least one pulley over which said endless dredging line runs, the trolleys being arranged to reciprocate in synchronism so that the direction of movement of the first trolley is staggered by one half-cycle relative to that of the other.

3. A device according to claim 2, in which said trolleys are mounted on guides.

4. A device for emptying dredging buckets attached by cables to points spaced along a continuously moving endless dredging line, said device comprising:

first guide means including a generally horizontal channel for guiding movement of the buckets;

means defining an emptying station associated with said guide means and including:

first and second trolleys mounted on guides arranged to move in synchronism in opposite directions along generally-vertically extending paths between first and second positions, in the first positions the endless dredging line passing over said trolleys in a substantially straight line parallel to said guide means, in the second positions the endless dredging line passing over said trolleys and being moved by said trolleys away from said guide means;

second guide means positioned between said first and said second trolleys and cooperating with said trolleys in said first positions to define a substantially straight path for guiding the endless dredging line;

means for controlling movement of said trolleys so that said first trolley is in said first position and said second trolley is in said second position prior to arrival of a bucket at said emptying station, said first trolley being moved towards said second position, after the point of attachment of a bucket to the dredging line passes the first trolley, at a rate of speed sufficiently fast to substantially stop movement of the point of attachment at said second guide means; and actuatable means associated with said first guide means for dumping a bucket when movement of its point of attachment is substantially stopped.

5. A device according to claim 4, in which said actuatable means comprises a tilting plate which forms part of a floor of said channel and which is arranged to pivot about one end on a horizontal axis perpendicular to the direction of movement of the buckets through the emptying station, and a hopper which opens at the floor of said channel and is mounted to receive the contents of successive buckets on tilting of the plate.

6. A device according to claim 4, wherein said second guide means comprises a pulley, wherein said means defining an emptying station further comprises an inlet pulley positioned upstream of said first trolley and an outlet pulley positioned downstream of said second trolley, said inlet and outlet pulleys forming a substantially horizontal path, with the pulley of said second guide means being positioned approximately midway between said inlet and said outlet pulleys, and wherein each of said trolleys includes a first pulley substantially alignable with the inlet and outlet pulleys when said trolleys are in said first positions, thereby defining a substantially straight path for guiding the endless dredging line.

7. A device according to claim 6, in which said actuatable means comprises a tilting plate which forms part of a floor of said channel and which is arranged to pivot about one end on a horizontal axis perpendicular to the direction of movement of the buckets through the emptying station, and a hopper which opens at the floor of said channel and is mounted to receive the contents of successive buckets on tilting of the plate.

8. A device according to claim 6, wherein each of said trolleys includes a second pulley for guiding the endless dredging line.

9. A device for emptying dredging buckets attached by cables to points spaced along a continuously moving endless dredging line, said device comprising:

substantially horizontally-extending first guide means for guiding movement of the buckets; and means defining an emptying station associated with said guide means and including:

first and second bodies arranged to move in synchronism in opposite directions along generally-vertically extending paths between first and second positions, in the first positions the endless dredging line passing over said bodies in a substantially straight line parallel to said guide means, in the second positions the endless dredging line passing over said bodies and being moved by said bodies away from said guide means, each of said bodies including a trolley mounted on a guide for movement along substantially straight paths for guiding the endless dredging line;

means for controlling movement of said bodies so that said first body is in said first position and said second body is in said second position prior to arrival of a bucket at said emptying station, said first body being moved towards said second position, after the point of attachment of a bucket to the dredging line passes the first body, at a rate of speed sufficiently fast to substantially stop movement of the point of attachment at said second guide means; and actuatable means associated with said first guide means for dumping a bucket when movement of its point of attachment is substantially stopped.

10. A device according to claim 9, wherein said first guide means includes a horizontal channel and wherein said actuatable means comprises a tilting plate which forms part of a floor of said channel and which is arranged to pivot about one end of a horizontal axis perpendicular to the direction of movement of the buckets through the emptying station, and a hopper which opens at the floor of said channel and is mounted to receive the contents of successive buckets on tilting of the plate.

* * * * *